United States Patent [19]

Friedman

[11] 4,277,529

[45] Jul. 7, 1981

[54] BONDING OF LIGHTWEIGHT TISSUE PAPER

[75] Inventor: Norman J. Friedman, Monmouth Junction, N.J.

[73] Assignee: Johnson & Johnson, New Brunswick, N.J.

[21] Appl. No.: 874,166

[22] Filed: Feb. 1, 1978

[51] Int. Cl.[3] ..... B05D 3/02; B05D 5/00; B32B 3/00; B32B 7/00

[52] U.S. Cl. ..... 428/211; 260/29.4 UA; 427/288; 427/391; 428/511; 428/530; 525/163; 525/164

[58] Field of Search ..... 427/288, 391, 191, 210, 427/239; 260/851, 852, 855, 857 F, 857 G, 857 D, 880 R, 883, 29.4 UA; 162/72, 135, 159, 204; 428/211, 511, 530; 525/164, 163

[56] References Cited

U.S. PATENT DOCUMENTS

| | | | |
|---|---|---|---|
| Re. 28,957 | 9/1976 | Drelich et al. | 427/331 |
| 2,526,462 | 10/1950 | Edelstein | 428/270 |
| 2,784,159 | 3/1957 | Fluck et al. | 427/394 X |
| 2,867,549 | 1/1959 | Outterson | 427/391 X |
| 2,931,742 | 4/1960 | Hicks | 260/851 X |
| 2,935,471 | 5/1960 | Aarons et al. | 428/245 X |
| 2,994,620 | 8/1961 | Franck et al. | 427/391 X |
| 3,262,838 | 7/1966 | Vieth et al. | 260/851 X |
| 3,310,459 | 3/1967 | Guthrie | 162/12 |
| 3,365,414 | 1/1968 | Fisk et al. | 260/851 X |
| 3,719,628 | 3/1973 | Bergomi et al. | 260/29.7 W |
| 3,880,792 | 4/1975 | Faessinger | 260/29.2 N |
| 3,883,463 | 5/1975 | Jin et al. | 260/851 X |
| 3,922,244 | 11/1975 | Stephens et al. | 260/855 X |
| 3,936,542 | 2/1976 | Cox | 427/288 |

*Primary Examiner*—Michael R. Lusignan
*Attorney, Agent, or Firm*—Charles J. Metz

[57] ABSTRACT

There is disclosed bonded lightweight tissue paper having improved wet and dry tensile strength and excellent softness and absorbency. The paper is produced by a process which comprises applying a binder composition to a dry web of lightweight soft and absorbent tissue paper, wherein the binder composition comprises an aqueous mixture containing a cross-linkable latex, a cross-linking agent, urea, and a specific combination of inorganic salts.

8 Claims, 1 Drawing Figure

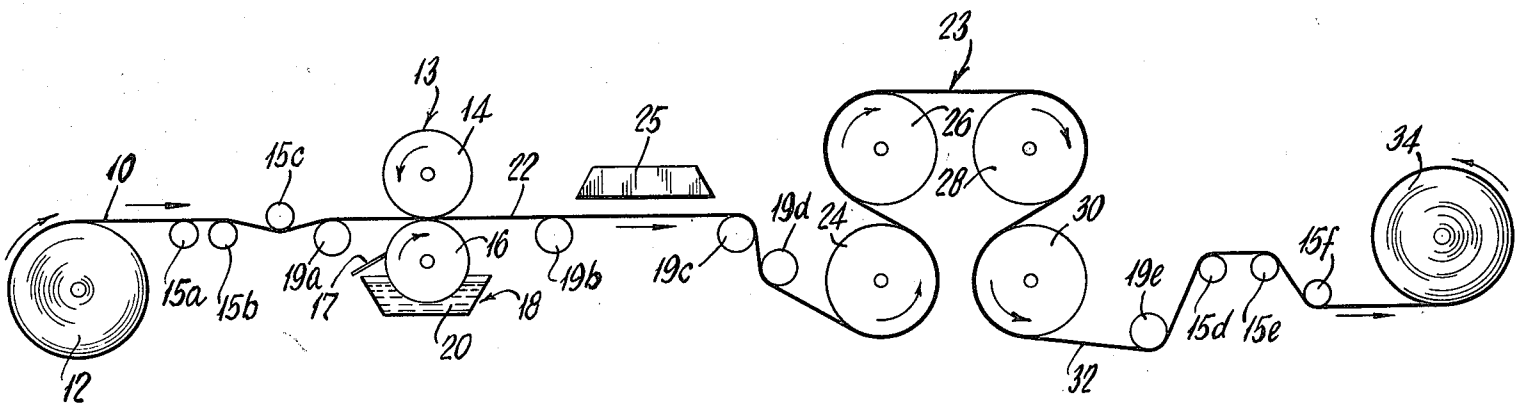
10
12
15a
15b
15c
13
14
16
17
18
19a
19b
19c
19d
19e
20
22
23
24
25
26
28
30
32
34
15d
15e
15f

BONDING OF LIGHTWEIGHT TISSUE PAPER

This invention relates to a process for bonding lightweight tissue paper, and to the improved paper produced thereby.

BACKGROUND OF THE INVENTION

Nonwoven fabrics are employed as cover sheets for absorbent underpads and similar articles. The present invention is directed to a less expensive substitute for such nonwoven fabrics and to a process for producing the same. The requirements of such a substitute are a relatively high degree of softness and absorbency coupled with sufficient wet strength to stand up to the expected use.

Lightweight tissue paper that has been made soft and absorbent (as by dry creping) is a possible candidate for such utility. However, in attempting to upgrade the wet strength sufficiently to qualify tissue paper for this use, it is difficult to retain the required softness and absorbency. The present invention is based upon the discovery of an effective process for producing soft and absorbent lightweight tissue paper having adequate wet strength to qualify it for use as an absorbent underpad cover.

SUMMARY OF THE INVENTION

The invention provides lightweight tissue paper having improved wet and dry tensile strength and excellent softness and absorbency properties. The process for making said paper comprises the steps of:

(a) applying an aqueous composition containing a curable resin binder to a dry web of soft and absorbent lightweight tissue paper; and (b) subjecting the treated web product of step (a) to elevated temperature to dry the water from the aqueous composition and cure the resin binder.

It is a characteristic feature of the invention that the aqueous resin binder composition contains (i) at least one cross-linkable latex polymer (ii) a melamine-formaldehyde resin or a urea-formaldehyde resin, and (iii) urea and a mixture of ammonium salts.

The Prior Art

It is known to print bond cellulosic webs with cross-linkable latex resins. For instance, see Phillips et al., U.S. Pat. No. 3,898,123, wherein a wet web of cellulosic fibers is print bonded with many different types of latex resins, including some that are cross-linkable as well as some that are not; Cox, in U.S. Pat. No. 3,936,542, discloses the print bonding of wet fibrous webs (including wet paper webs) that have been treated to give them an alkaline pH, with an acidic latex binder composition, some of the latex binders being cross-linkable (see, for instance, Example I wherein a cross-linkable vinyl acetate acrylic latex with monoammonium phosphate as a latent acid catalyst is used to print bond a wet nonwoven textile web); Drelich, et al. in Reissue No. 28,957 (originally U.S. Pat. No. 3,849,173) discloses the print bonding of wet fibrous webs, including wet paper webs, with an aqueous latex resin composition containing metal ammonium complexes, with the latexes being cross-linkable latexes in many cases.

Ammonium salts combined with urea have been disclosed for use in paper and other fibrous webs as flameproofing agents. See, for example, Aarrons, et al., U.S. Pat. No. 2,935,471, Fluck et al., U.S. Pat. No. 2,784,159, and Edelstein, U.S. Pat. No. 2,526,462.

It is known that urea-formaldehyde resins and melamine-formaldehyde resins can be used to cross-link latex resins that are used as binders in papermaking. See, for example, Daniel, J. H., Jr., U.S. Pat. No. 2,906,724, Sept. 29, 1959, and Koral et al., "Thermosetting Acrylic Emulsions based on Hexakis(Methoxymethyl) Melamine", *Journal of Paint Technology*, 38, 610 (1966).

Faessinger, in U.S. Pat. No. 3,880,792, discloses the use of cationic urea-formaldehyde resins in printing inks for decorative use on paper, and mentions that acid catalysts, including ammonium chloride, can be used in conjunction with said resins.

THE DRAWING

The single FIGURE is a simplified, diagrammatic, schematic flow chart illustrating an arrangement of apparatus that can be employed to carry out the process of the invention.

DESCRIPTION OF THE INVENTION

The process of the invention is illustrated by the following procedure:

A web 10 of lightweight tissue paper is fed from a supply roll 12 over (or under) idler rolls 15*a*, 15*b*, 15*c* and a spreader bar 19*a* to a print bonding station 13. The print bonding station includes a pair of counter rotating rolls 14, 16. The upper roll 14 can be a rubber coated roll, and the lower roll 16 is a printing roll containing a predetermined pattern of grooves etched in the surface thereof. The engraved roll 16 is immersed in a container 18 of an aqueous resin binder composition 20. As the engraved roll 16 rotates in the bath of aqueous resin binder composition 20 it picks up said composition, and a doctor blade 17 wipes the surface of the engraved roll 16 so that the resin composition remains only in the grooves of the roll 16. Thus, as the web 10 of lightweight tissue paper passes through the nip of the rolls, 14, 16, it is printed with the aqueous resin binder composition 20 in the pattern of the engraved grooves on the surface of the engraved roll 16. After passing through the printing station 13, the printed web 22 passes through a preliminary drying station 25, such as a bank of infrared lights or a hot air oven, with spreader bars 19*b* and 19*c* positioned before and after the drying station 25, and then to a second drying station 23, such as a series of drying cans 24, 26, 28, 30, wherein the aqueous resin binder composition is dried and cured. A spreader bar 19*d* is located just in front of the first drying can 24. After the binder has been dried, the dried web 32 product then passes under another spreader bar 19*e* and over (or under) a series of idlers 15*d*, 15*e*, 15*f*, to a windup roll 34.

The process of the invention employs soft and absorbent lightweight tissue paper. Such paper can be produced by a conventional papermaking process using dry creping to achieve the desired softness and absorbency. The process of the invention is particularly applicable to the use of tissue paper that lacks sufficient wet strength to survive wet processing. Such paper will contain at most a very small proportion of wet strength resin. The lightweight tissue paper contemplated is a paper having a basis weight of 30 pounds or less per ream of 3000 square feet. The preferred tissue paper has a basis weight of about 10 to 12 pounds per 3000 square foot ream. The paper is made from papermaking cellulosic fibers (preferably bleached) derived from hardwood, softwood, or both. A preferred tissue paper is composed of a 60/40 (by weight) softwood/hardwood combination having a basis weight of 10–12 pounds per 3000 square foot ream. This paper has an optimum combination of opacity, softness, and dry strength.

The tissue paper can contain enough wet strength resin so that it can support its own weight in water. For example, the tissue paper may have a CD wet tensile strength of up to about 30 grams per inch (by TAPPI T-404). Less wet strength resin than this may be used, but not more, since the use of more would detract from the desired softness/absorbency characteristics. In most cases, the wet strength resin will be used in amounts of less than about 10 or 15 pounds of wet strength resin per ton of dry paper. Epichlorohydrin polyamine condensates are illustrations of wet strength resins that can be employed.

The web of soft and absorbent lightweight tissue paper that is employed in the process of the invention is not pretreated in any way by the addition of water or any other additive prior to the application to the web with the resin binder composition. Usually the paper employed will be at "equilibrium dryness". That is, the paper will be at equilibrium with the moisture in the atmosphere. The exact moisture content will therefore vary with the humidity, and may be from 2 to 10 weight percent, although 4 to 8 weight percent is more usual.

An aqueous binder composition is preferably applied to the web in an intermittently-spaced print pattern. The pattern can be of a type which is known to the art. Such patterns include cross-hatch patterns (U.S. Pat. No. 2,705,687), dot or annuli patterns (U.S. Pat. No. 2,705,688), diamond patterns (FIG. 3, U.S. Pat. No. 2,705,498), torpedo patterns (U.S. Pat. No. 3,009,823), and the like. The printing is done by the procedures that are known to the art. Alternatively, the binder can be applied to the web in an overall saturation pattern, as by a padding procedure. However, to achieve maximum absorbency in the treated paper of the invention, it is preferred to apply the binder in an intermittently-spaced print pattern.

The aqueous resin binder composition constitutes a major point of novelty of the invention. The aqueous binder composition contains a cross-linkable latex polymer, a cross-linking agent, urea, and a mixture of ammonium salts.

The cross-linkable latex polymers employed in the invention constitute a known class of compositions. Such latex polymers are water-dispersible acrylic, methacrylic, vinyl ether, vinyl ester, vinyl halide, olefin, synthetic rubber, vinylidene chloride, and the like, polymers which contain a reactive pendant group on the polymeric backbone. The reactive group is typically carboxyl or alcoholic hydroxyl, although others such as glycidyl are also operative. The most frequently encountered reactive groups are those obtained by incorporating N-methylol acrylamide, N,N-dimethylol acrylamide, hydroxyethyl acrylate, acrylic acid, maleic acid, or the like, in the polymer. The latex polymer is capable of self-crosslinking, or of cross-linking by interacting with an aminoplast resin, or both.

The cross-linking agent is an aminoplast resin, such as a melamine-formaldehyde resin or a urea-formaldehyde resin. The aminoplast resins that are contemplated are heat curable and are capable of having their cure accelerated by an acid catalyst. These materials also constitute a known class of compositions.

The aqueous resin binder composition also contains urea, diammonium phosphate, and ammonium bromide.

The proportions in which the components of the aqueous resin binder composition are employed have not been found to be narrowly critical. The approximate range of useful proportions of the basic ingredients in the aqueous resin binder composition is displayed in Table I (all weights are on a solids basis).

TABLE I

| | Approximate Range of Proportions | |
|---|---|---|
| | Parts, by weight | |
| Ingredient | Range | Preferred |
| Cross-linkable Latex Polymer | 100 | 100 |
| Aminoplast Cross-linking Agent | 0.5–44 | 7–8 |
| Urea | 1–140 | 18–22 |
| Diammonium Phosphate | 0.1–140 | 1–2.5 |
| Ammonium Bromide | 2–140 | 30–40 |

The total solids in the treating bath is usually of the order of 35 to 45 weight percent.

The total add-on of binder composition to the paper is also not narrowly critical, and will usually vary from about 10 to about 30 weight percent.

The aqueous latex binder composition can also contain other materials that are conventionally used in the art. These materials include pigments, dyes, anti-blocking agents such as polyethylene wax emulsion, surfactants to stabilize the treating bath and enhance penetration of the web, and the like. These materials are employed in conventional amounts, as illustrated in Example 1, below.

The tissue paper web upon which the curable resin binder has been applied, is subjected to elevated temperatures to evaporate the water in the binder composition and to cure the resin binder. Drying at 220° to 280° F. is illustrative of convenient drying conditions. The web, after drying, must be subjected to an elevated temperature sufficient to initiate the resin curing reaction. A minimum of about 300° F. for a short period of time (e.g., one minute) is ordinarily required for this purpose. Once initiated, the resin curing reaction will continue, even at lower temperatures. Apparently, the elevated temperature drives off ammonia from the urea/ammonium salt mixture, which permits the latent acidity of the salt to catalyze the cure of the aminoplast resin.

EXAMPLE 1

A laboratory scale paper-treating apparatus was employed to treat dry-creped tissue paper having a basis weight of 11.5 pounds per ream of 3000 square feet. The paper contained 7.8 pounds of wet strength resin per ton of dry paper (specification range-5.9 to 9.8 pounds per ton), and was made from a 60/40 (by weight) softwood/hardwood pulp mixture. The treating apparatus had a printing station similar to that identified in the Figure herein by reference numeral 13, followed by a bank of infrared lights as a preliminary drying station.

The preliminary drying is desirable to reduce sticking in subsequent handling (this is true for both lab scale and larger scale operation). Final drying and cure was effected by placing the treated paper in a hot air oven for about one minute at 300° F.

The aqueous treating bath had the composition shown in Table II, below:

TABLE II

| Ingredient | Treating Bath Composition: Dry parts, by weight(1) | Solids %(2) | Weight, grams(3) |
|---|---|---|---|
| Water | — | — | 477.2 |
| Diammonium Phosphate | 0.116 | 100 | 5.8 |
| Ammonium Bromide | 2.327 | 100 | 116.16 |
| Urea | 1.435 | 100 | 71.63 |
| "Calox RG" surfactant(4) | 0.078 | 25 | 15.48 |
| Polyethylene emulsion(5) | 0.062 | 40 | 6.19 |
| "Airflex 120" latex(6) | 2.453 | 52 | 235.48 |
| "Pliolite LPR 4744" latex(7) | 9.812 | 46.5 | 526.67 |
| Blue Pigment(8) | 0.058 | 32 | 9.07 |
| "Cymel 373"(9) | 0.582 | 80 | 36.3 |
| "B-52" surfactant(10) | 0.078 | 30 | 9.2 |
| Totals | 17.001 | 40 | 1509.2 |

(1)"Dry parts, by weight", refers to the approximate parts, by weight, of the ingredient per 100 parts by weight of paper, in the final product.
(2)"Solids" refers to the percent solids of the ingredient as added to the mixture. In most cases, the diluent is all or predominantly water.
(3)"Weight" is the weight of the ingredient added to the treating bath, including any diluent.
(4)Calox RG (manufactured by Cal Chemical Co., Coventry, RI), promotes uniform color in the print pattern.
(5)Polyethylene emulsion used as anti-blocking agent.
(6)"Airflex 120" latex is a cross-linkable ethylene/vinyl acetate latex containing a small proportion of N,N-dimethylolacrylamide. In addition to acting as a cross-linkable resin binder, it helps to make the Pliolite and ammonium salts compatible.
(7)"Pliolite LPR 4744" latex is a cross-linkable carboxylated styrene/butadiene latex.
(8)Phthalocyanine blue pigment
(9)A melamine/formaldehyde resin
(10)"B-52" (Polymerics, Inc., Waltham, MA) - helps to promote adhesion of the treating bath composition to the paper substrate.

The ingredients were added to the bath in the order listed in Table II. After the addition of the "Pliolite LPR 4744", the pH of the bath was adjusted to 7.5 by adding ammonium hydroxide. A defoamer ("Troykyd 566"—Troy Chemical Company, Newark, NJ) was added to the bath in an amount of 0.1 weight percent (1.5 grams). The add-on of the treated, dried, and cured paper was 16.22 weight percent.

The untreated paper, the paper treated as indicated above, and the treated paper containing added flame retardant ("Auralux 423", an aqueous solution of inorganic salts, produced by the Auralux Company, Hope Valley, RI—the added flame retardant was simply sprayed on the treated paper, which was dried to remove the water, to yield a total add-on of about 25 percent), were all tested for tensile strength, stretch, and 45° flame retardancy, with the results indicated below in Table III:

TABLE III

| Tensile Strength, by TAPPI T-404 (pounds/inch) | Evaluation of Paper: Untreated Paper | Treated Paper | Treated Paper with added flame retardant |
|---|---|---|---|
| MD, dry | 2.64 | 3.9 | 3.6 |
| MD, wet | 0.53 | 1.71 | 1.48 |
| CD, dry | 0.68 | 1.0 | 0.72 |
| CD, wet | 0.13 | 0.4 | 0.61 |
| Stretch, %, by TAPPI T-404 | | | |
| MD, dry | 16.9 | 11.0 | 10.0 |
| MD, wet | 6.0 | 7.2 | 8.2 |
| CD, dry | 5.7 | 8.4 | 11.0 |
| CD, wet | 4.96 | 6.8 | 10.0 |
| 45° Flame, by NFPA 702, Class 3 (seconds) | | | |
| MD | 1.78 | 2.3 | 4.8 |
| CD | 1.90 | 2.23 | 3.9 |

The NFPA 702, Class 3, specification is 3 seconds or higher.

The absorbency of the paper was evaluated as follows:

The facing sheet of a commercial disposable diaper was removed, and replaced with the sheet to be tested. 100 Milliliters of water was emptied onto the diaper through a 100-ml pipette at an angle of 30°-50° (up from the horizontal), and the time required for the water to penetrate the facing and be absorbed by the wadding underneath was measured. The results were as follows:

(a) With the diaper's own facing—37.2 seconds;

(b) With the untreated tissue paper used in this Example—37.0 seconds;

(c) With the treated tissue paper of this Example containing the Auralux 423 flame retardant—37.8 seconds.

Control Example

A series of samples of the dry creped tissue paper described in Example 1 were hand-dipped in the treating baths described below in Table IV, blotted, and dried under infrared lamps for 2 minutes. The dried, treated papers were then qualitatively evaluated for stiffness (or softness), absorbency, and wet strength. The results are displayed in Table IV, below.

TABLE IV

| Ingredient in Treating Bath | Wet Parts, by weight Sample No. 1 | 2 | 3 | 4 | 5 | 6 | 7 | 8 | 9 | 10 | 11 |
|---|---|---|---|---|---|---|---|---|---|---|---|
| Water | 48 | 48 | 48 | 48 | 48 | 48 | 48 | 48 | 48 | 48 | 48 |
| "Pliolite LPR 4744" latex | 53 | 53 | 53 | 53 | 53 | 53 | 53 | 53 | 53 | 53 | 53 |
| "Cymel 373" | 3.6–20(1) | — | — | — | 20 | 20 | 20 | 20 | 20 | 20 | 20 |
| Diammonium Phosphate | — | 0.6–53(1) | — | — | 10.6 | — | — | 26 | 26 | 26 | 26 |
| Ammonium Bromide | — | — | 11.7–53(1) | — | — | 22.7 | — | — | — | 24 | 24 |
| Urea | — | — | — | 7.2–53(1) | — | — | 17.2 | — | 24 | — | 24 |
| Softness | stiff | — | — | — | stiff | stiff | soft | stiff | soft | stiff | soft |
| Wet Strength | none | none | none | none | excellent | fair | none | excellent | none | excellent | excellent |
| Absorbency | — | — | — | — | — | — | — | — | — | non-absorbent | absorbent |

| Ingredient in Treating Bath | Wet Parts, by weight Sample No. 12 | 13 | 14 |
|---|---|---|---|
| Water | 48 | 48 | 48 |
| "Pliolite LPR 4744" latex | 53 | 53 | 53 |
| "Cymel 373" | — | 20 | 20 |
| Diammonium Phosphate | — | — | — |
| Ammonium Bromide | 24 | 24 | 24 |
| Urea | 24 | 24 | 14 |

TABLE IV-continued

| | | | |
|---|---|---|---|
| Softness | soft | stiff | stiff |
| Wet Strength | none | fair | fair |
| Absorbency | absorbent | slow to absorb | slow to absorb |

(1)Several samples were run, with the amounts varying within the range indicated.

The control example demonstrates that it is necessary to employ a combination of urea, diammonium phosphate, and ammonium bromide in order to obtain softness, wet strength, and absorbency.

What is claimed is:

1. Process for bonding lightweight, soft, and absorbent tissue paper to improve both wet and dry tensile strength while retaining softness and absorbency, which process comprises the steps of:

(a) applying an aqueous composition containing a curable resin binder to a dry web of lightweight, soft, and absorbent tissue paper; and (b) subjecting the product of step (a) to elevated temperature to cure said resin binder and evaporate the water from said aqueous composition, wherein said aqueous composition contains:

(i) at least one polymer in latex form, said polymer being capable of self-crosslinking, or said polymer being capable of cross-linking by reacting with an aminoplast resin;

(ii) an aminoplast resin, said aminoplast resin being heat-curable, wherein the rate of cure of said aminoplast resin is acceleratable in the presence of acid;

(iii) urea;

(iv) diammonium phosphate; and (v) ammonium bromide.

2. Process of claim 1 wherein said aqueous composition is applied to said paper in an intermittent print pattern.

3. Process of claim 2 wherein said aminoplast resin is a melamine/formaldehyde resin.

4. Process of claim 2 wherein said polymer in latex form is a mixture of a carboxylated styrene/butadiene polymer and an ethylene/vinyl acetate polymer containing a small proportion of copolymerized N,N-dimethylolacrylamide.

5. The product produced by the process of claim 1.

6. The product produced by the product of claim 2.

7. The product produced by the process of claim 3.

8. The product produced by the process of claim 4.

* * * * *